US006458750B1

(12) United States Patent
Dardin et al.

(10) Patent No.: US 6,458,750 B1
(45) Date of Patent: Oct. 1, 2002

(54) ENGINE OIL COMPOSITION WITH REDUCED DEPOSIT-FORMATION TENDENCY

(75) Inventors: Alexander Dardin, Buerstadt (DE); Klaus Hedrich, Fischbachtal (DE); Stephan Massoth, Biblis (DE); Boris Eisenberg, Darmstadt (DE); Stephan Fengler, Gross-Zimmern (DE)

(73) Assignee: Rohmax Additives GmbH, Darmstadt (DE)

( * ) Notice: Subject to any disclaimer, the term of this patent is extended or adjusted under 35 U.S.C. 154(b) by 0 days.

(21) Appl. No.: 09/868,309

(22) PCT Filed: Feb. 24, 1999

(86) PCT No.: PCT/EP00/01534

§ 371 (c)(1),
(2), (4) Date: Jun. 18, 2001

(87) PCT Pub. No.: WO00/52117

PCT Pub. Date: Sep. 8, 2000

(30) Foreign Application Priority Data

Mar. 4, 1999 (GB) ..... 199 09 401

(51) Int. Cl.[7] ..... C10M 129/16; C10M 129/70; C10M 145/36; C10M 145/38

(52) U.S. Cl. ..... 508/501; 508/503; 508/579

(58) Field of Search ..... 508/501, 579

(56) References Cited

U.S. PATENT DOCUMENTS

| | | | | | |
|---|---|---|---|---|---|
| 2,850,455 | A | | 9/1958 | Kern et al. | 508/414 |
| 3,426,738 | A | | 2/1969 | Goodwine, Jr. | 123/573 |
| 3,898,168 | A | | 8/1975 | Brehm | 508/398 |
| 4,302,349 | A | * | 11/1981 | Kosswig et al. | 508/579 |
| 4,402,845 | A | * | 9/1983 | Zoleski et al. | 508/579 |
| 4,438,005 | A | * | 3/1984 | Zoleski et al. | 508/501 |
| 4,493,776 | A | * | 1/1985 | Rhodes | 508/579 |
| 4,585,565 | A | * | 4/1986 | Tsai | 508/501 |
| 4,731,190 | A | * | 3/1988 | O'Lenick, Jr. et al. | 508/501 |
| 4,830,769 | A | * | 5/1989 | O'Lenick, Jr. et al. | 508/501 |
| 5,143,640 | A | * | 9/1992 | Moxey | 508/579 |
| 5,204,012 | A | | 4/1993 | Schaffhausen | 508/399 |
| 5,652,204 | A | * | 7/1997 | Cracknell et al. | 508/562 |
| 5,759,968 | A | * | 6/1998 | Furutani et al. | 508/497 |
| 5,942,473 | A | * | 8/1999 | Knerr et al. | 508/465 |
| 6,133,211 | A | * | 10/2000 | Cobianco et al. | 508/579 |

FOREIGN PATENT DOCUMENTS

| | | |
|---|---|---|
| EP | 0 438 709 | 7/1991 |
| GB | 828867 | 2/1960 |
| GB | 2 206 600 | 1/1989 |

OTHER PUBLICATIONS

Smalheer et al, "Lubricant Additives", Section I–Chemistry of Additives, pp. 1–11, 1967.*

* cited by examiner

*Primary Examiner*—Ellen M. McAvoy
(74) *Attorney, Agent, or Firm*—Oblon, Spivak, McClelland, Maier & Neustadt, P.C.

(57) ABSTRACT

The invention relates to engine oil compositions with reduced deposit-formation tendency which contain between 0.05 and 10% by weight, in relation to the total weight of the engine oil composition, of an alkyl alkoxylate of formula (I), in which R 1 , R 2 and R 3 independently are hydrogen or a hydrocarbon rest with up to 40 carbon atoms; R 4 is hydrogen, a methyl or ethyl rest; L is a linking group; n is a whole number between 4 and 40; A is an alkoxy group with between 2 and 25 recurring units derived from ethylene oxide, propylene oxide and/or butylene oxide and comprises homopolymers and statistical copolymers of at least two of the above compounds; and z is 1 or 2. The nonpolar part of compound (I) of the formula (II) contains at least 9 carbon atoms. The invention also relates to the preparation of such engine oils and to the use of alkyl alkoxylates of formula (I) for the reduction of deposit formation.

20 Claims, No Drawings

ENGINE OIL COMPOSITION WITH REDUCED DEPOSIT-FORMATION TENDENCY

The present invention relates to engine-oil compositions with reduced tendency to form deposits and to the use of alkyl alkoxylates.

According to the prior art as of today, the crank mechanism, piston group, cylinder running path and valve control system of an internal combustion engine are lubricated with an engine oil developed for this particular application. In the closed oil space of the engine, the engine oil, which collects in the oil pan of the engine, is conveyed by delivery pump through an oil filter to the individual lubrication points.

In this system the engine oil has the functions of:

=>reducing friction—reducing wear

=>cooling the components

=>gastightly sealing the piston from the combustion space

In this connection, the oil is subjected to the following loads during operation:

=>contact with hot components (up to higher than 300° C.)

=>presence of air (oxidation), nitrogen oxides (nitration), fuel and its combustion residues (wall condensation, ingress of material in liquid form) and carbon particles from combustion (ingress of solid foreign substances).

=>At the instant of combustion, the oil film on the cylinder is exposed to intense radiated heat.

=>The turbulence generated by the crank mechanism of the engine creates a large active surface of the oil in the form of droplets in the gas space of the crank mechanism and gas bubbles in the oil pan.

In the course of engine operation, the listed loads of evaporation, oxidation, nitration, dilution with fuel and ingress of particles change the engine oil itself and components of the engine which are wetted with engine oil during operation. Consequently, the following effects among others occur which are not desired for satisfactory operation of the engine:

1. Change of the viscosity (determined in the low-temperature range at 40 and 100° C.)
2. Pumpability of the oil at low outside temperatures
3. Deposit formation on hot and cold components of the engine This phenomenon includes the development of gummy layers (of brown to black color) all the way to formation of carbon. These deposits impair the function of individual components, such as free movement of the piston rings and constriction of air-conveying components of the turbocharger (diffusor and spirals). Consequently, serious engine damage or power loss is suffered and the exhaust-gas emissions increase.

Furthermore, a spongy deposit layer forms preferentially on the horizontal surfaces of the oil space, and in the extreme case can also clog oil filters and oil ducts of the engine, also leading to engine damage.

4. Reduction of wear protection

To ensure trouble-free engine operation, the engine manufacturers specify a maximum useful life of the engine oil (mileage or service time between oil changes) and require proof of the performance capability of an engine oil in the form of test results of standardized test procedures and engine tests (such as API classification in the USA or ACEA test sequences in Europe). In addition, procedures defined by the manufacturer itself are also used to be able to evaluate engine oil in terms of its suitability.

The reduction of deposit formation and the assurance of greater detergency and dispersion capability over a long useful life is of crucial importance in the foregoing release procedures.

Example of ACEA Test Sequences 1998

Category A (Spark-ignition Engines):

In 6 engine test procedures, oil deposits are determined 10 times, wear 4 times and viscosity 2 times. For determination of the deposition behavior, piston cleanness is evaluated 3 times, piston-ring sticking 3 times and sludge formation3 times.

Category B (Light Diesel Engines)

In 5 engine test procedures, oil deposits are determined 7 times, wear 3 times and viscosity 2 times. For determination of the deposition behavior, piston cleanness is evaluated 4 times, piston-ring sticking 2 times and sludge formation one time.

Category E (Heavy Diesel Engines)

In 5 engine test procedures, oil deposits are determined 7 times, wear 6 times and viscosity one time. For determination of the deposition behavior, piston cleanness is evaluated 3 times, sludge formation 2 times and turbo deposition one time.

The numbers indicate that deposit formation is the most important element of the performance capability of an engine oil.

The use of detergents and dispersants in motor fuels and lubricants is unavoidable in order to prevent deposits and to control insoluble constituents in the engine oil. In this connection, usually ionic compounds containing metal salts (ash-forming) are used as detergents and nonionic ("ashless") compounds are used as dispersants ("Chemistry and Technology of Lubricants", Mortier, R. M., Orszulik, S. T., Editors, VCH Publishers, Inc., New York).

The action of these surfactant substances as detergents or dispersants is based on their amphiphilic nature (polar-nonpolar), which endows them with properties similar to those of a conventional soap in water, albeit with the difference that they are oil-soluble. The nonpolar moiety, which usually comprises one or more relatively long or even oligomeric or polymeric alkyl groups, ensures adequate solubility in the appropriate medium which, for example, is a mineral or synthetic oil, whereas the polar moiety is necessary mainly so that the amphiphile can adhere to impurities.

Typical ionic compound classes are the alkylsulfonates, alkylphenates, alkylsalicylates and alkylphosphonates with either calcium, magnesium or sodium as the counterion. They are used mainly as lubricant detergents, in order to prevent or minimize deposits and gum formation on pistons, for example. In addition, they often ensure a certain degree of protection against rusting. Nonionic amphiphiles such as poly(isobutylene) succinimide and poly(oxyalkylene) carbamates and polyamines as well as compounds derived therefrom have been used mainly as dispersants since 1950 in order to keep carbon and other oil-insoluble oxidation products in solution. Their structure is similar to that of the detergents, but in this case the polar moiety of the compound comprises oxygen-containing or nitrogen-containing hydrocarbon groups, such as poly(ethyleneamine) or poly (ethylene oxide). The nonpolar, oil-soluble moiety usually has polymeric nature and, for example, is a poly (isobutylene) group.

For example, WO 84/04754 (U.S. Pat. No. 4,438,022) describes a motor fuel and lubricant composition containing about 10,000 ppm of a hydrocarbylmethylol polyoxyalkylene aminoethane, which functions both as a detergent and as a dispersant for keeping the intake system in internal combustion engines clean.

Furthermore, WO 88/01290 discloses, as a detergent or dispersant in lubricating oils (for engine, hydraulic, marine and two-stroke applications) a multiply alkylated succinimide, in which one or more nitrogen atoms are substituted by a hydroxyhydrocarbyl oxycarbonyl group, U.S. Pat. No. 5,558,683 explains Mannich bases comprising a phenolic unit and a polyamine moiety, which in turn are joined via a urea bridge to a poly(oxyalkylene) moiety. What is claimed is motor fuel and additive compositions which, by virtue of the addition of the said compound, permit control of deposits in the ignition zone ("induction system") of internal combustion engines.

GB A 2206600 describes an additive formulation which functions to improve the viscosity index. Among other alternatives, a surfactant which contains alkoxy groups is used as the phase mediator. Reduction of deposit formation, however, is not mentioned.

U.S. Pat. No. 5,204,012 describes a lubricating-oil composition which contains an esterification product from the reaction of a block copolymer of ethylene oxide and propylene oxide with a long-chain fatty acid. This additive functions to inhibit corrosion. An effect with respect to the formation of deposits is not mentioned.

In view of the prior art cited and discussed herein, it was the object of the present invention to specify engine-oil compositions which exhibit only very slight deposits.

Another object of the invention is to eliminate the disadvantage of the aforesaid known systems, namely very complex and therefore expensive manufacture.

Furthermore, the stability of known compositions, systems or formulations is in need of improvement. This is particularly relevant, since the motor-vehicle manufacturers are progressively lengthening the respective maintenance intervals at which the engine oil is changed.

These objects are achieved by an engine-oil composition described in claim 1, as are other objects which indeed are not explicitly cited but which can be derived as obvious from the relationships discussed herein or which necessarily follow therefrom.

Preferred embodiments of the inventive composition are described in the claims referred back to claim 1.

As regards the manufacturing process, the subject matter of claim 11 provides the solution to the problem on which the object is based.

The solution of the object with regard to the use of alkyl alkoxylates is provided by the subject matter of claim 12.

In an inventive engine-oil composition, it is possible, by means of a content, relative to the total weight of the engine-oil composition, of 0.05 to 10 wt % of an alkyl alkoxylate of formula (I)

$$R^1—[—(CR^2R^3)_n—]_z—L—A—R^4 \quad (I),$$

wherein $R^1$, $R^2$ and $R^3$ are independently hydrogen or a hydrocarbon group containing up to 40 carbon atoms, $R^4$ is hydrogen or a methyl or ethyl group, L is a linker group, n is an integral number ranging from 4 to 40, A is an alkoxy group with 2 to 25 repeating units, which are derived from ethylene oxide, propylene oxide and/or butylene oxide, A comprising homopolymers as well as statistical copolymers of at least two of the said compounds, and z is 1 or 2, wherein the nonpolar moiety of compound (I), whose formula is (II)

$$R^1—[—(CR^2R^3)_n—]_z—L \quad (II)$$

contains at least 9 carbon atoms, to provide in a manner that cannot be directly foreseen, engine-oil compositions with reduced tendency to form deposits, the additives used for reduction of deposit formation in such compositions being capable of being manufactured particularly easily and inexpensively.

By the use of an alkyl alkoxylate of formula (I)

$$R^1—[—(CR^2R^3)_n—]_z—L—A—R^4 \quad (I)$$

wherein $R^1$, $R^2$ and $R^3$ are independently hydrogen or a hydrocarbon group containing up to 40 carbon atoms, $R^4$ is hydrogen or a methyl or ethyl group, L is a linker group, n is an integral number ranging from 4 to 40, A is an alkoxy group with 2 to 25 repeating units, which are derived from ethylene oxide, propylene oxide and/or butylene oxide, A comprising homopolymers as well as statistical copolymers of at least two of the said compounds, and z is 1 or 2, as an additive for engine oils to reduce deposit formation, it is also possible to achieve the objects mentioned hereinabove in a manner that is excellent and not directly foreseeable.

The following advantages in particular are achieved by the inventive measures:

The compounds added as additive to the inventive engine-oil compositions in order to reduce the formation of deposits are very stable, thus permitting very long intervals between oil changes.

The compounds added as additive to the engine-oil compositions of the present invention in order to reduce the formation of deposits are very effective.

According to the invention, the engine-oil composition must contain a compound of formula (I)

$$R^1—[—(CR^2R^3)_n—]_z—L—A—R^4 \quad (I),$$

wherein $R^1$, $R^2$ and $R^3$ are independently hydrogen or a hydrocarbon group containing up to 40 carbon atoms, $R^4$ is hydrogen or a methyl or ethyl group, L is a linker group, n is an integral number ranging from 4 to 40, A is an alkoxy group with 2 to 25 repeating units, which are derived from ethylene oxide, propylene oxide and/or butylene oxide, A comprising homopolymers as well as statistical copolymers of at least two of the said compounds, and z is 1 or 2, wherein the nonpolar moiety of compound (I), whose formula is (II)

$$R^1—[—(CR^2R^3)_n—]_z—L \quad (II)$$

contains at least 9 carbon atoms. Within the context of the invention, these compounds are referred to as alkyl alkoxylates. These compounds can be used both individually or as a mixture.

Within the context of the invention, hydrocarbon groups with up to 40 carbons atoms are to be understood as, for example, saturated and unsaturated alkyl groups, which may be straight-chain, branched or cyclic, as well as alkyl groups that can also contain hetero atoms and alkyl substituents, and which can if necessary contain substituents, such as halogens.

Of these groups, C1 to C20 alkyl, especially C1 to C8 alkyl and very especially C1 to C4 alkyl groups are preferred.

The expression "C1 to C4 alkyl" is to be understood as an unbranched or branched hydrocarbon group with 1 to 4 carbon atoms, such as the methyl, ethyl, propyl, isopropyl, 1-butyl, 2-butyl, 2-methylpropyl or tert-butyl group;

the expression "C1 to C8 alkyl" is to be understood as the foregoing alkyl groups as well as, for example, the pentyl, 2-methylbutyl, I.T-dimethylpropyl, hexyl, heptyl, octyl or 1,1,3,3-tetramethylbutyl group;

the expression "C1 to C20 alkyl" is to be understood as the foregoing alkyl groups as well as, for example, the nonyl, 1-decyl, 2-decyl, undecyl, dodecyl, pentadecyl or eicosyl group.

Furthermore, C3 to C8 cycloalkyl groups are preferred as the hydrocarbon group. These include among others the cyclopropyl, cyclobutyl, cyclopentyl, cyclohexyl, cycloheptyl or cyclooctyl group.

Furthermore, the group may also be unsaturated. Of these groups,

"C2 to C20 alkenyl", "C2 to C20 alkynyl" and especially "C2 to C4 alkenyl" as well as "C2 to C4 alkynyl" are preferred. The expression "C2 to C4 alkenyl" is to be understood as, for example, the vinyl, allyl, 2-methyl 2-propenyl or 2-butenyl group;

the expression "$C_2$ to $C_{20}$ alkenyl" is to be understood as the foregoing groups as well as, for example, the 2-pentenyl, 2-decenyl or 2-eicosenyl groups;

the expression "$C_2$ to $C_4$ alkynyl" is to be understood as, for example, the ethynyl, propargyl, 2-methyl-2-propynyl or 2-butynyl groups;

the expression "$C_2$ to $C_{20}$ alkenyl" is to be understood as the foregoing groups as well as, for example, the 2-pentynyl or 2-decynyl groups.

Furthermore, aromatic groups such as "aryl" or "heteroaromatic ring systems" are preferred. The expression "aryl" is to be understood as an isocyclic aromatic group with preferably 6 to 14, especially 6 to 12 C atoms, such as phenyl, naphthyl or biphenylyl, preferably phenyl;

the expression "heteroaromatic ring system" is to be understood as an aryl group wherein at least one CH group is replaced by N and/or at least two adjacent CH groups are replaced by S, NH or O, examples being a group of thiophene, furan, pyrrole, thiazole, oxazole, imidazole, isothiazole, isoxazole, pyrazole, 1,3,4-oxadiazole, 1,3,4-thiadiazole, 1,3,4-triazole, 1,2,4-oxadiazole, 1,2,4-thiadiazole, 1,2,4-triazole, 1,2,3-triazole, 1,2,3,4-tetrazole, benzo[b]thiophene, benzo[b]furan, indole, benzo[c]thiophene, benzo[c]furan, isoindole, benzoxazole, benzothiazole, benzimidazole, benzisoxazole, benzisothiazole, benzopyrazole, benzothiadiazole, benzotriazole, dibenzofuran, dibenzothiophene, carbazole, pyridine, pyrazine, pyrimidine, pyridazine, 1,3,5-triazine, 1,2,4-triazine, 1,2,4,5-triazine, quinoline, isoquinoline, quinoxaline, quinazoline, cinnoline, 1,8-naphthyridine, 1,5-naphthyridine, 1,6-naphthyridine, 1,7-naphthyridine, phthalazine, pyridopyrimidine, purine, pteridine or 4H-quinolizine.

The groups $R^2$ or $R^3$, which may be present repeatedly in the hydrophobic moiety of the molecule, can each be the same or different.

The linker group L functions to join the polar alkoxide moiety of the inventive alkyl alkoxide with the nonpolar alkyl group. Suitable groups include, for example, aromatic groups such as phenoxyl (L=—$C_6H_4$—O—), groups derived from acids, such as ester groups (L=—CO—O—), carbamate groups (L=—NH—CO—O—) and amide groups (L=—CO—NH—), ether groups (L=—O—) and keto groups (L=—CO—). Particularly stable groups such as the ether, keto and aromatic groups are preferred for this purpose.

As mentioned hereinabove, n is an integral number ranging from 4 to 40, especially from 10 to 30. If n is larger than 40, the viscosity produced by the inventive additive is generally too high. If n is smaller than 4, the lipophilicity of the moiety of the molecule is generally not sufficient to keep the compound of formula (I) in solution. Accordingly, the nonpolar moiety of compound (I) having formula (II) preferably contains 10 to 100 carbon atoms in total and most especially preferably 10 to 35 carbon atoms in total.

The polar moiety of the alkyl alkoxylate is represented by A in formula (I). It is assumed that this moiety of the alkyl alkoxylate can be represented by formula (III)

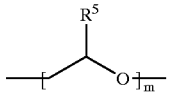

wherein the group $R^5$ denotes hydrogen or a methyl group and/or ethyl group and m is an integral number ranging from 2 to 40, preferably 2 to 25, especially 2 to 15 and most particularly preferably 2 to 5. Within the context of the present invention, the said numerical values are to be understood as mean values, since this part of the alkyl alkoxylate is generally obtained by polymerization. If m is larger than 40, the solubility of the compound in the hydrophobic environment is too low, and so turbidity and sometimes precipitation can occur in the oil. If the number is smaller than 2, the desired effect cannot be assured.

The polar moiety can contain units derived from ethylene oxide, propylene oxide and/or butylene oxide, ethylene oxide being preferred. For this purpose it is permissible for the polar moiety to contain only one of these units. On the other hand, all of these units may also be present statistically in the polar group.

The number z depends on the choice of linker group or on the starting compounds used. It has a value of 1 or 2.

Preferably, the number of carbon atoms of the nonpolar moiety of the alkyl alkoxylate according to formula (II) is larger than the number of carbon atoms of the polar moiety (A), probably represented by formula (III), of this molecule. The nonpolar moiety preferably contains at least twice as many carbon atoms as the polar moiety, especially preferably three times the number or more.

The synthesis of the alkyl alkoxylates depends among other factors on the type of linker group chosen. For example, inventive additives containing an ether group are obtained by the reaction of so-called fatty alcohols with ethylene oxide, propylene oxide and/or butylene oxide.

Furthermore, long-chain fatty acids, for example, can also be ethoxylated. In the process, esters are obtained.

If suitable phenols are used as starting material, alkyl alkoxylates with an aromatic linker group are obtained.

All of these reactions are known in themselves. The person skilled in the art will find useful information in, for example, Ullmann's Encyclopedia of Industrial Chemistry, Fifth Edition on CD ROM, 1998 edition.

Many inventive alkyl alkoxylates suitable as the additive for reduction of deposit formation are commercially available.

Examples are the ®Marlipal and ®Marlophen.types of CONDEA and the ®Lutensol types of BASF.

Examples of the foregoing are ®Marlophen NP 3 (nonylphenol polyethylene glycol ether (3EO)), ®Marlophen NP 4 (nonylphenol polyethylene glycol ether (4EO)), ®Marlophen NP 5 (nonylphenol polyethylene glycol ether (5EO)), ®Marlophen NP 6 (nonylphenol polyethylene glycol ether (6EO));

®Marlipal 1012/6 (C10 to C12 fatty alcohol polyethylene glycol ether (6EO)), ®Marlipal MG (C12 fatty alcohol polyethylene glycol ether), ®Marlipal 013/30 (C13 oxo alcohol polyethylene glycol ether (3EO)), ®Marlipal 013/40 (C13 oxo alcohol polyethylene glycol ether (4EO));

®Lutensol TO 3 (i-C13 fatty alcohol with 3 EO units), ®Lutensol TO 5 (i-C13 fatty alcohol with 5 EO units), ®Lutensol TO 7 (i-C13 fatty alcohol with 7 EO units), ®Lutensol TO 8 (i-C13 fatty alcohol with 8 EO units) and ®Lutensol TO 12 (i-C13 fatty alcohol with 12 EO units).

The inventive engine-oil composition contains 0.05 to 10 wt % of alkyl alkoxylates of formula (I) relative to the total weight of the mixture. If the proportion is smaller than 0.05 wt %, the reduction of deposit formation occurs only inadequately. The upper limit is determined primarily by economic considerations.

Engine oils in the context of the present invention are to be understood as oils that satisfy one or more of the performance requirements listed in the introduction.

The inventive compositions can also be interpreted as engine-oil formulations.

These oils generally contain a base oil as well as one or more additives that are widely known to those skilled in the art.

In principle, any compound which ensures an adequate lubricating film that does not break up even at elevated temperatures is suitable as the base oil. The viscosities, for example, as defined in the SAE specifications, for example, can be used to determine this property.

Among others, compounds which are particularly suitable have a viscosity ranging from 15 Saybolt seconds (SUS, Saybolt Universal Seconds) to 250 SUS, preferably from 15 to 100 SUS, in each case determined at 100° C.

The compounds suitable for this purpose include natural oils, mineral oils and synthetic oils as well as mixtures thereof.

Natural oils are animal or plant oils, such as neatsfoot oils or jojoba oils. Mineral oils are obtained mainly by distillation from crude oils. They are advantageous in particular because of their favorable price. Synthetic oils include organic esters and synthetic hydrocarbons, especially polyolefins, which satisfy the foregoing requirements. They are usually somewhat more expensive than the mineral oils, but have advantages in terms of their performance capability.

These base oils can also be used as mixtures, and in many cases are commercially available.

Besides the base oil, engine oils generally contain additives. The additives impart favorable flow behavior at low and high temperatures (improvement of the viscosity index), and they suspend solids (detergent-dispersant behavior), neutralize acid reaction products and form a protective film on the cylinder surface (EP additive, for "extreme pressure"). In addition, antiaging agents, pour-point depressors, corrosion inhibitors, coloring agents, demulsifiers and fragrances are used. The person skilled in the art will find further useful information in Ullmann's Encyclopedia of Industrial Chemistry, Fifth Edition on CD ROM, 1998 edition.

The proportions in which these additives are used depend on the area of application of the lubricant. In general, however, the proportion of the base oil rangesfrom 25 to 90 wt %, preferably 50 to 75 wt %. The additives can also be used as so DI packages (detergent-inhibitor), which are widely known and can be obtained commercially .

Besides the base oil, particularly preferred engine oils contain, for example 0.1 to 1 wt % of pour-point depressors, 0.5 to 15 wt % of viscosity improvers, 0.4 to 2 wt % of antiaging agents, 2 to 10 wt % of detergents, 1 to 10 wt % of lubricity improvers, 0.0002 to 0.07 wt % of antifoaming agents, 0.1 to 1 wt % of corrosion inhibitors.

The inventive engine oil can be produced by mixing the components. For this purpose the alkyl alkoxylate of formula (I) is added directly to the engine-oil composition as a constituent of the VI improver, as a constituent of the DI package or as a constituent of a lubricant concentrate, or is added later to the oil. In this connection, reprocessed spent oils can also be used as the oil.

For this purpose there can also be used lubricant concentrates which contain, for example, 5 to 95% of the alkyl alkoxylates of formula (I), 95 to 5% of a lubricating oil and optionally 0 to 70% of a VI improver.

The present invention will be explained in more detail hereinafter on the basis of examples which, however, are not to be construed as limitative.

Assessment of Deposit Formation

Oil deposits are determined by a visual method defined in DIN or CEC, in which the condition and thickness of the deposit are documented first of all. By means of a characterizing number system for weighting the condition and thickness, an assessment number from 0 to 10 or 100 respectively is determined for the individual assessed component, and an assessment number is determined as a mean value of all assessed components for the entire engine and thus for the oil.

Of the foregoing values, "0" means totally covered with carbon or sludge, and "10" and "100" respectively mean as clean as the new, never used part.

As illustrated in Example 1, the examined additives have a positive effect on deposit formation in engine operation, demonstrated here by the example of the VWTDIC test, which is part of the scope of testing of ACEA Category B.

EXAMPLE 1 AND COMPARISON EXAMPLE 1

An inventive engine-oil composition B was mixed by addition of an ashless detergent according to formula (I) (Marlipal 24/20) and was subjected to the CEC-L-46-T-93 engine test (1.6 liter VW turbo diesel intercooler) to determine its effect on deposit prevention. For comparison, there was used a corresponding conventional composition A, which did not contain any inventive alkyl alkoxylate of formula (I).

15W-40 compositions were mixed from the commercially available components listed in Table 1, and were subjected to the CEC-L-46-T-93 test. The deposits formed in the engine were then assessed according to the procedure cited hereinabove.

The results obtained are listed in Table 1.

TABLE 1

| Component | Comparison 1 Composition A Proportion (wt %) | Example 1 Composition B Proportion (wt %) |
|---|---|---|
| Paratone 8002 | 8.5 | 8.5 |
| OLOA 4594 | 13.2 | 13.1 |
| ESSO 600N | 26.0 | 26 |
| ESSO 150N | 52.3 | 51.3 |
| Marlipal 24/20 | — | 1.0 |
| Assessment | 69.7 points | 74.4 points |

OLOA 4594 of the Oronite Co. is a commercial DI package which also contains ash-forming detergents which contain, for example, calcium, zinc, magnesium.

Paratone 8002 of the Exxon/Paramins Co. (which recently became Chevron/Oronite) is a commercial VI improver for engine oils that contains olefin copolymers (OCP).

What is claimed is:

1. A method of reducing deposit formation in an engine comprising lubricating an engine with an oil comprising a base oil and an alkyl alkoxylate of formula (I)

$$R^1—[—(CR^2R^3)_n]_z—L—A—R^4 \quad (I),$$

wherein $R^1$, $R^2$ and $R^3$ are independently hydrogen or a hydrocarbon group containing up to 40 carbon atoms, $R^4$ is hydrogen or a methyl or ethyl group L is a linker group, n is an integer ranging from 4 to 40, A is an alkoxy group with 2 to 40 repeating units, which are derived from ethylene oxide, propylene oxide and/or butylene oxide, A comprising homopolymers as well as statistical copolymers of at least two of the said compounds, and z is 1 or 2, wherein L is an ester group and wherein the nonpolar portion of compound (I), whose formula is (II)

$$R^1—[—(CR^2R^3)_n—]_z—L \quad (II)$$

contains at least 9 carbon atoms.

2. The method of claim 1, wherein n lies between 10 and 30.

3. The method of claim 1, wherein the nonpolar portion of compound (I) having formula (II) contains 10 to 100 carbon atoms in total.

4. The method of claim 3, wherein the nonpolar portion of compound (I) having formula (II) contains 10 to 35 carbon atoms in total.

5. The method of claim 1, wherein the group A contains 2 to 15 repeating units, which are derived from ethylene oxide, propylene oxide and/or butylene oxide.

6. The method of claim 5, wherein the group A contains 2 to 5 repeating units, which are derived from ethylene oxide, propylene oxide and/or butylene oxide.

7. The method of claim 1, wherein the nonpolar portion of the alkyl alkoxylate of formula (II) contains more carbon atoms than the group A.

8. The method of claim 1, wherein the nonpolar portion of the alkyl alkoxylate of formula (II) contains at least twice as many carbon atoms as the group A.

9. The method of claim 1, wherein the group A is derived from ethylene oxide.

10. The method of claim 1, wherein the engine oil further comprises 0.1 to 1 wt % of pour-point depressors, 0.5 to 15 wt.% of viscosity improvers, 0.4 to 2 wt % of antiaging agents, 2 to 10 wt % of detergents, 1 to 10 wt % of lubricity improvers, 0.0002 to 0.07 wt % of antifoaming agents, 0.1 to I wt % of corrosion inhibitors and 25 to 90 wt % of base oil, each relative to the total weight of the engine oil.

11. A method of reducing deposit formation in an engine comprising lubricating an engine with an oil comprising a base oil and an alkyl alkoxylate of formula (I)

$$R^1—(—(CR^2R^3)_n—)_z—L—A—R^4 \quad (I)$$

wherein $R^1$, $R^2$ and $R^3$ are independently hydrogen or a hydrocarbon group containing up to 40 carbon atoms, $R^4$ is a methyl or ethyl group, L is a linker group, N is an integer ranging from 4 to 40, A is an alkoxy group with 2 to 40 repeating units, which are derived from ethylene oxide, propylene oxide and/or butylene oxide, A comprises homopolymers and statistical copolymers of at least two of the said alkoxy groups, and z is 1 or 2, wherein L is an ether or ester group and wherein the nonpolar portion of compound (I), whose formula is (II)

$$R^1—(—(CR^2R^3)_n—)_z—L \quad (II)$$

contains at least 9 carbon atoms.

12. The method of claim 11, wherein n lies between 10 and 30.

13. The method of claim 11, wherein the nonpolar portion of compound (I) having formula (II) contains 10 to 100 carbon atoms in total.

14. The method of claim 11, wherein the nonpolar portion of compound (I) having formula (II) contains 10 to 35 carbon atoms in total.

15. The method of claim 11, wherein the group A contains 2 to 15 repeating units, which are derived from ethylene oxide, propylene oxide, and/or butylene oxide.

16. The method of claim 11, wherein the group A contains 2 to 5 repeating units, which are derived from ethylene oxide, propylene oxide, and/or butylene oxide.

17. The method of claim 11, wherein the nonpolar portion of the alkyl alkoxyl ate of formula (II) contains more carbon atoms than the group A.

18. The method of claim 11, wherein the nonpolar portion of the alkyl alkoxylate of formula (II) contains at least twice as many carbon atoms as the group A.

19. The method of claim 11, wherein the group A is derived from ethylene oxide.

20. The method of claim 11, wherein the engine oil further comprises 0.1 to 1 wt % of pour-point depressors, 0.5 to 15 wt.% of viscosity improvers, 0.4 to 2 wt % of antiaging agents, 2 to 10 wt % of detergents, 1 to 10 wt % of lubricity improvers, 0.0002 to 0.07 wt % of antifoaming agents, 0.1 to 1 wt % of corrosion inhibitors and 25 to 90 wt % of base oil, each relative to the total weight of the engine oil.

* * * * *

UNITED STATES PATENT AND TRADEMARK OFFICE

CERTIFICATE OF CORRECTION

PATENT NO. : 6,458,750 B1
DATED : October 1, 2002
INVENTOR(S) : Dardin et al.

It is certified that error appears in the above-identified patent and that said Letters Patent is hereby corrected as shown below:

Title page,
Item [22], should read:
-- [22] PCT Filed: Feb. 24, 2000 --
Item [30], should read:
-- [30] Foreign Application Priority Data
Mar. 4, 1999 (DE) ..... 199 09 401 --

Signed and Sealed this

Twenty-fifth Day of February, 2003

JAMES E. ROGAN
*Director of the United States Patent and Trademark Office*